US005524676A

United States Patent [19]

Scorl et al.

[11] Patent Number: 5,524,676

[45] Date of Patent: Jun. 11, 1996

[54] WEAVING LOOM WITH ARTICULATED SUCTION APPARATUS FOR REDUCING DEPOSITION OF FLY LINT AND DUST

[75] Inventors: Hans-Dieter Scorl; Stephan Arndt, both of Lindau, Germany; Trinh duy Dien, Hanoi, Viet Nam

[73] Assignee: Lindauer Dornier Gesellschaft mbH, Lindau, Germany

[21] Appl. No.: 416,327

[22] Filed: Apr. 4, 1995

[30] Foreign Application Priority Data

Apr. 7, 1994 [DE] Germany ..... 44 11 963.1

[51] Int. Cl.[6] ..... D03J 1/00

[52] U.S. Cl. ..... 139/1 C; 15/345

[58] Field of Search ..... 15/314, 315, 322, 15/345, 346; 139/1 C

[56] References Cited

U.S. PATENT DOCUMENTS

| | | | |
|---|---|---|---|
| 4,074,387 | 2/1978 | Arato et al. | 15/322 |
| 4,676,277 | 6/1987 | Gillespie et al. | 139/1 C |
| 4,869,296 | 9/1989 | Shaw | 139/1 C |

FOREIGN PATENT DOCUMENTS

| | | | |
|---|---|---|---|
| 0535501 | 4/1993 | European Pat. Off. | 139/1 C |
| 365985 | 9/1906 | France | 15/314 |
| 1385540 | 12/1964 | France . | |
| 1919229 | 3/1970 | Germany . | |
| 1679571 | 1/1976 | Germany . | |
| 584302 | 1/1977 | Switzerland . | |

*Primary Examiner*—Andy Falik
*Attorney, Agent, or Firm*—W. G. Fasse; W. F. Fasse

[57] ABSTRACT

A high proportion of fly lint and dust is intercepted inside a loom before settling, by a suction device (17, 18) positioned inside the loom below the rear shed and the heald frames so that air from a blower head (3) movably mounted (at 4) above the loom must pass through the rear shed and between the heald frames. The suction device has a plurality of suction boxes (18) pivotally interlinked with each other to form a suction channel chain (17) which is flexible so that the position of the suction channel chain (17) can be adapted to the space available inside the loom for an effective interception of fly lint and dust. One section of the suction channel chain extends approximately horizontally parallel to and below the rear shed, while another suction channel chain section extends approximately vertically and approximately parallel to the heald frames.

10 Claims, 3 Drawing Sheets

WEAVING LOOM WITH ARTICULATED SUCTION APPARATUS FOR REDUCING DEPOSITION OF FLY LINT AND DUST

FIELD OF THE INVENTION

The invention relates to a loom and more specifically a weaving loom with a cleaning device for reducing the deposition of fly lint and dust in the weaving loom. Such devices have at least one blower head that is positioned above a weaving plane and a suction device positioned below the weaving plane.

BACKGROUND INFORMATION

In recent years it has been a tendency to increase the weft insertion frequencies and thus the beat-up frequencies in looms having a single phase weft insertion and beat-up. However, a drawback of these higher weaving frequencies is the fact that the warp yarn threads and the weft thread yarn are exposed to larger stress as compared to the respective stress in looms with lower weaving frequencies. Thus, limits to the weaving frequency are set by the strength of the weft and warp yarns. Another limitation factor to be considered is the wear of the yarns that is caused by the higher stress to which these yarns are exposed. The fiber wear in turn results in an increased fly lint and dust production inside the loom and in the air around the loom on the weaving floor.

Investigations regarding the fly lint distribution in the loom show that about 75% of the fiber or thread wear takes place in the area of the rear shed while about 20% take place in the area of the heald frame. In the area of the loom backrest and in the area of the lamellae or drop wires the thread wear results primarily in sizing dust while in the area of the rear shed and of the heald frame the thread wear results primarily in fly lint. The cause for the thread wear or fiber wear is the mutual friction between the warp threads and the forceful opening or separation of weft threads tending to stick to each other when the shed is being opened.

French Patent Publication 1,385,540 (Reiterer et al.) describes a cleaning apparatus for looms having a pneumatic blowing head arranged above the weaving plane. Incidentally, the weaving plane is defined as a plane extending substantially horizontally and tangentially to the beat-up line and to the top of the loom backrest. The blower head is movable back and forth above the weaving plane displaceable across the weaving width. A plurality of downwardly extending blowing nozzles are directed onto the weaving plane. Inside the loom and below the weaving plane there is arranged a suction device with a funnel-shaped suction opening. The funnel forming the suction opening has relatively flat funnel walls with surfaces reaching in the direction of the warp thread run-in in such a way that the funnel covers the area of the warp thread guide and the area of the shed formation. The suction device further has a portion below the funnel which extends substantially vertically.

A funnel-shaped suction device as disclosed in the above mentioned French Patent Publication has the disadvantage that its relatively flat walled suction opening requires an enormously high suction power in order to produce enough suction in the area of the suction opening for the intended dust removal. A high suction power requires a high energy consumption. Experience has shown that even where the suction device cooperates with a simultaneously operating blower head, deposition and sticking of fly lint and other dust components is unavoidable on the surfaces of the suction device that extend relatively flat or approximately parallel to the weaving plane. Thus, it is necessary, to remove these contaminations by additional efforts, for example, by a manual cleaning.

Swiss Patent Publication 584 302 (Müller) discloses a pneumatic cleaning device on a loom, especially a ribbon loom, wherein blower nozzles are arranged below the weaving plane, especially in the area of the shed formation. These blowing nozzles are directed toward the shed formation area. A suction device is arranged above the weaving plane, especially in the area of the shed formation opposite the blower nozzles. In such a cleaning device the blower nozzles are stationary in the loom. Thus, the blower nozzles are not adaptable to the variable conditions in the area of the shed formation. For example, it is not possible without substantial redesign to adapt the blower nozzles to a changed rear shed when a shuttleless or rapier loom is to be reset from two heald frames to maximally twenty-eight heald frames. In such a situation the stationary blower nozzles do not achieve the required cleaning effect with the enlarged number of heald frames. The limitation in the variability of the blower device with regard to its adaptability to various shed formations is thus a substantial drawback.

German Patent Publication DE-OS 1,919,229 (Gleaton et al.) discloses another possibility of removing fly lint and the like from a loom. A large number of blow nozzles which are movable back and forth above the weaving plane in a loom emit air jets of such a strength that any fly lint depositions are blown away or these jets make sure that depositions do not occur in the first place. The air nozzles emit flow speeds in the range of about 300 to 6000 m/min. since the blowing nozzle arrangement does not cooperate with a suction device, a substantial problem is generated because the lint flies into the air of the weaving hall so that avoiding the problem of a proper lint removal in accordance with environmental requirements is not assured.

German Patent Publication 1,679,571 (Black, Jr.) discloses a pneumatical cleaning device for the removal of fly lint depositions. The device is mounted on a bridge that is movable back and forth and can be positioned above the loom. The blower head of this known cleaning apparatus comprises at least one downwardly directed blowing nozzle reaching toward the loom. The fly lint that is caught by the airstream from the blowing nozzle is blown into the interior of the loom where it is intercepted by a stationary arranged floor suction device. Such a blowing nozzle is conventionally spaced relatively far away from the floor suction nozzle of the loom, so that a controlled interception of the fly lint whirled up by the blowing air is not assured, regardless how powerful the floor suction nozzles might be.

OBJECTS OF THE INVENTION

In view of the above it is the aim of the invention to achieve the following objects singly or in combination:

to construct a suction device that cooperates with a blower head arranged above the weaving plane for back and forth movement, in such a way that the suction device is adaptable to the structural conditions inside the loom;

to position and adapt a flexible suction device in such a manner that a large proportion of fly lint and dust inside the loom are intercepted and transported away at a minimal energy consumption, in other words, with a low suction power;

to provide a control mechanism that permits, through the operation of switching valves to coordinate blowing airstreams with suction airstreams for an efficient removal of contaminations from the loom;

to make a suction device for the present purposes in a flexible way such that it can take into account variations in the loom shed formation; and to provide an environmentally satisfactory removal of contaminations from the loom before such contaminations can enter into the air of the weaving hall.

SUMMARY OF THE INVENTION

The above objects have been achieved according to the invention in that the suction device arranged below the weaving plane and cooperating with a blowing device arranged above the weaving plane, is so constructed that it forms a type of link chain with its suction boxes that are articulated to each other to form flexibly positionable suction channels that extend across the width of the loom and so that the suction channel chain is adaptable in the horizontal plane approximately to the geometry and the depth of the rear shed while portions of the suction device extending in a vertical plane are oriented parallel to the heald frames in a direction toward the loom bottom.

Valve controls are provided for the blower head and for the individual suction channels or suction boxes of the suction channel chain so that, for example, groups of suction channels can be coordinated relative to each other and/or driven with different suction effects by the simultaneously or individually controllable valves for the increase and decrease of the blower flow and of the suction flow, for example, in accordance with the amount of accumulation of contaminations in particular areas of the loom so that more suction is applied in these areas than in other areas and so that more or less blower air is applied depending on particular requirements in different areas within the loom.

The individual suction channel boxes are provided with suction slots in their surfaces facing the warp threads and the heald frames. The fly lint passes through these slots into the boxes which in turn are connected to a suction pipe for transporting the collected contaminations away. The suction pipes may be connected to the right end or to the left end of each suction channel or box. Connectors are provided at each end wall of each suction box and these connectors or one of these connectors may simultaneously function as a suction nipple to which a suction pipe or hose is connected. The connectors in turn are articulated by links to journal or pivot elements to form the chainlink type suction channel chains.

The pivot or journal elements are preferably located between two neighboring suction channels or boxes, whereby it is further preferred that the individual channels or boxes have slanted longitudinal wall sections to provide space for the pivot or journal elements between neighboring boxes.

The suction channel chain is supported within the loom near the loom frame side walls on a position adjustable support rail or two such rails so that the position of the suction boxes relative to the depth of the rear shed is now possible without difficulties.

It is an important advantage of the invention that the interception of fly lint and dust is brought as close as possible to the areas having an especially high lint and dust concentration so that interception takes place substantially directly at the point of generation of lint and dust. Another advantage is seen in that the invention avoids the contamination, for example of optical sensors that control the weaving operation. Such contaminations have been a problem heretofore because lint and dust tended to settle on the sensors. As a result, interruptions of the weaving process could occur. Still another problem has been avoided by the invention, namely the weaving of fly lint into the fabric. The controlled air flows according to the invention prevent such fabric faults.

The suction channels or boxes can be manufactured in a simple manner of sheet metal or even of plastics material and the position and shape of these boxes are easily adaptable to the space conditions between the heald frames and the warp beam of the loom. Due to the attachment to repositionable support rails, the mounting and demounting is easily and quickly accomplished. The present cleaning device is equally useful in rapier looms and in air jet looms.

Another advantage of the invention is seen in that the air supplied to the blower head may be air conditioned and provided with the relative humidity required in the weaving hall.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
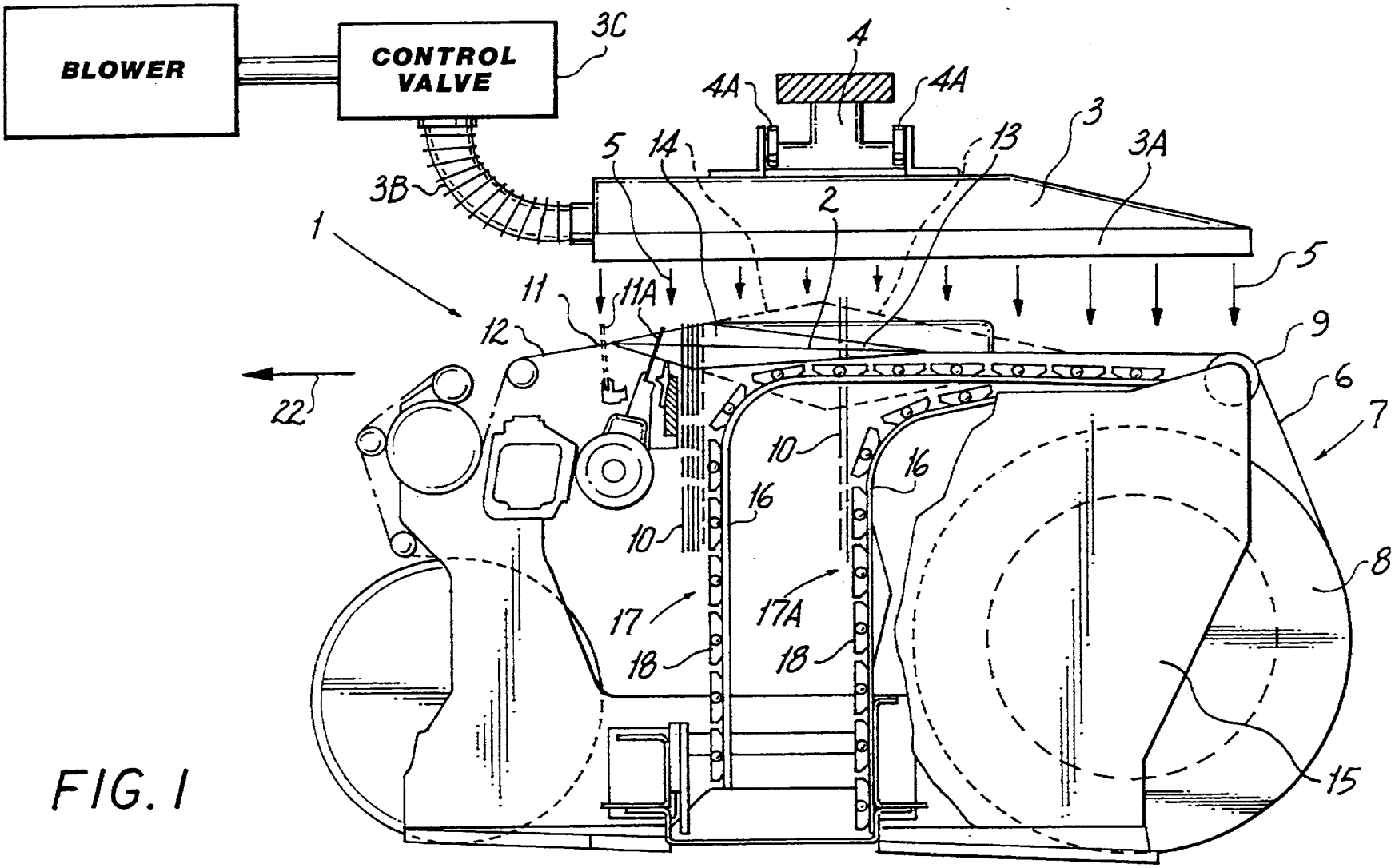
FIG. 1 is a schematic side view into a loom equipped with a cleaning device according to the invention including a blower head above the weaving plane and the flexible or articulated suction channel chain arranged in the space below the weaving plane.

Referring to FIG. 1, a blower head 3 is mounted above a weaving plane 2 in a loom 1. The blower head 3 has at least one blowing nozzle 3A opening downwardly onto the area between a loom backrest 9 and the beat-up line 11 of the reed 11A. The blower head 3 is, for example, mounted on a guide rail 4 secured to the hall ceiling. Wheels 4A permit moving the blower head 3 in a direction perpendicularly to the plane of the drawing sheet. Several blower heads 3 may be arranged on the same rail for serving a plurality of looms 1. Arrows 5 indicate the airstream coming from the blower nozzle 3A. These airstreams 5 are directed onto the warp threads 6 coming from the warp beam 8 for forming the rear shed 13 and the front shed 14. The warp threads 6 are pulled off the warp beam 8 and pass over the loom backrest 9 to the heald frames 10 which form the loom shed 13 with the warp threads 6. The weaving plane 2 passes approximately centrally through the shed. Depending on the number of heald frames 10, the rear shed 13 may be narrow as shown in full lines, or wider as shown in dashed lines. The blowing airstream 5 preferably also reaches over the front shed 14.

Figure 2:
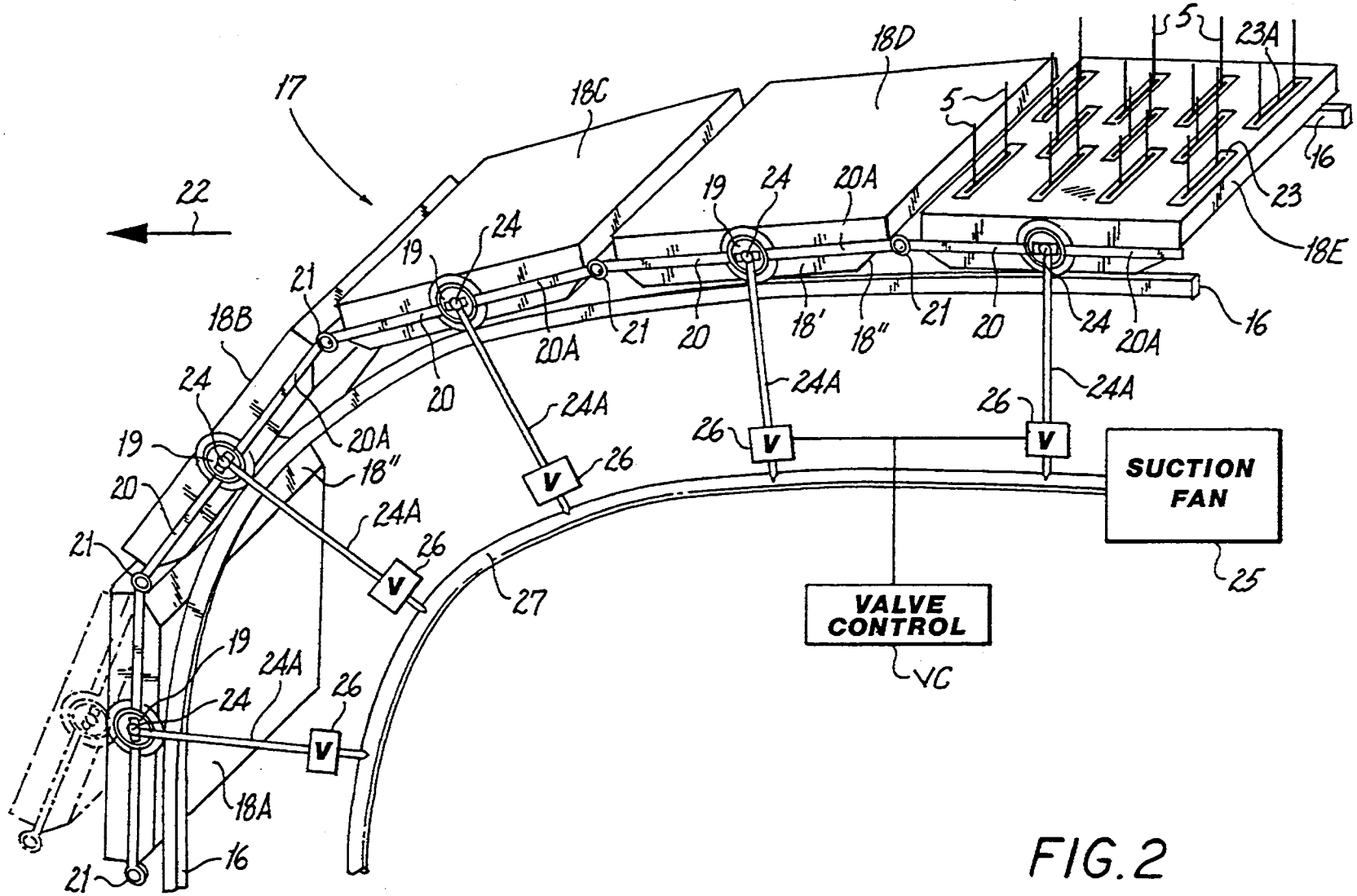
FIG. 2 is an enlarged perspective view of a portion of the present channel chain, including a suction hose connected to the individual suction boxes.
Figure 3:
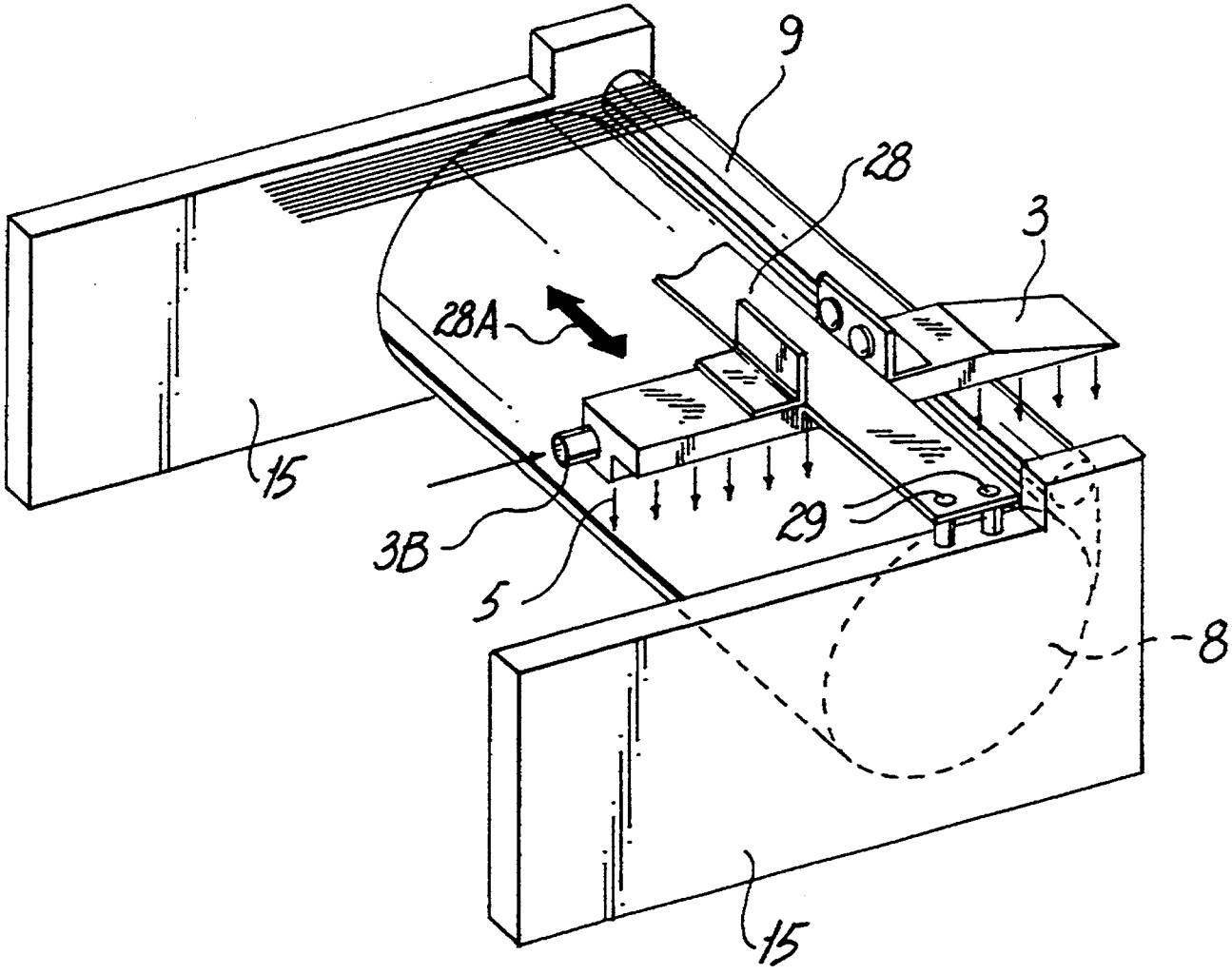
FIG. 3 is a perspective schematic view of the positioning of the blower head relative to the loom.

As best seen in FIG. 2, at least one, preferably two, support rails 16 are arranged or mounted to the loom frame in the area between the right and left loom frame members 15 seen in FIGS. 1 and 3 between the heald frames 10 and the warp beam 8. These support rails 16 are adjustable in their position relative to the depth of the rear shed 13. The support rail or rails 16 carries the suction channels or boxes 18 articulated to each other to form a channel chain 17 to be described below. The support rail 16 may, for example, comprise several sections that are secured by screws to the loom frame which is provided for this purpose for example with several threaded holes in different positions for repositioning these support rails 16 to thereby adjust the position of the boxes 18 relative to the shed 13, 14 and relative to the heald frames 10.

It is important that the suction channels or boxes 18 form an articulated suction channel chain 17 that can be arranged to approximate or accommodate the geometry of the rear shed 13 and of the heald frames 10, depending on whether the rear shed is wider or narrower. In FIG. 1 the chain 17 has a configuration for the full line rear shed 13 and for the heald frames 10 closer to the reed 11A. The chain 17A has a configuration for the dashed line rear shed and for the heald frames 10 further away from the reed. It is further important that the individual suction channels or boxes 18 are interconnected with each other in such a manner that the entire suction channel chain 17 is positionable in various positions within the loom 1 and below the rear shed 13. The suction channel chain 17 is carried by the support rails 16 in such a way that the channel chain is not only adaptable to the rear shed 13, but also has a section that extends vertically in a plane parallel to the heald frames 10. This arrangement of the suction channels or boxes 18 covers substantially that portion or area of the loom in which the main proportion of the fly lint and dust is generated.

The arrangement of valves V and the valve control VC electrically or mechanically connected to all valves V of the blower head 3 and for the suction channels 18 is shown only schematically in FIG. 2 since valves and their controls are known. The control is such that the blower stream or flow and the suction flows are controlled simultaneously or individually depending on where in the loom a particular cleaning operation needs to be done. It is important that several interconnected suction channels 18 of the chain 17 can be operated in suction groups or individually as required. For example, suction boxes 18A and 18B in FIG. 2 form one group, boxes 18C and 18D and 18E form another group and so forth. The control through the valve control VC is such that any suction channel that is a member of one group in one suction pattern may be part of another group in another suction pattern. All suction boxes 18 cooperate with the blower head 3.

FIG. 2 shows the articulation of the individual suction channels or boxes 18 to form the chain 17 which can assume the configurations shown in FIG. 1 at 17 and 17A and the dashed line position shown at the lower left in FIG. 2. The end walls 18' of each suction box 18 are provided with a connector 19. Preferably at least one of the two connectors 19 of a suction box 18 is constructed as a hollow stud for the articulated chainlink connection and as a suction nipple 24 to function as a connector for connecting a suction hose 24A to the respective suction box 18 at its nipple 24. Each connector 19 is rigidly secured to two linking elements 20 and 20A for connection to the neighboring box 18 with the aid of journal or pivot elements 21. Preferably, these elements 21 are pivot links or rollers that are positioned between two neighboring boxes 18 to contact a slanting longitudinal side wall 18", whereby each channel or box 18 is permitted to articulate clockwise or counterclockwise around one or the other element 21 to provide a chainlink effect. The linking elements 20, 20A may, for example, be rods or pipe sections. It is important, however, that the linking elements 20, 20A articulate the suction channels 18, 18A and so forth at the elements 21 to form a flexible suction channel chain 17 which is positionable within the loom 1 below the rear shed 13 and behind the heald frames 10 where these channel chains are mounted on support rails 16 so that part of the chain 17 extends approximately parallel to the shed 13 and part of the chain 17 extends parallel to the heald frames 10. The support rail or rails 16 are connected to the inwardly facing surface of the loom frame sections 15. The support rails 16 can be adjusted in their position in the weaving direction 22 and perpendicularly thereto. Any conventional positioning devices such as spindle drives or the like are suitable for the positioning of the support rails 16. Thus, the suction chain 17 is easily adaptable to the depth of the rear shed 13 that will depend on the number of heald frames 10 used.

FIG. 2 further shows that the suction channels or boxes 18A to 18E are provided with suction slots 23 facing the warp threads 6 and the heald frames 10. The cross-sectional area of the suction slots 23 is adjustable by varying the position of pivotally mounted closure flaps 23A. A flexible suction conduit or hose 24A is connected through the connector nipples 24 to each of the suction channels or boxes 18. These suction conduits or hoses 24A are connected to a central suction fan 25 through controllable valves 26 and a flexible or rigid suction duct 27. The valves 26 are so positioned and controlled that each box 18A, . . . can be provided with more or less suction individually or in groups depending on the quantity of lint and dust produced in any particular area or zone inside the loom.

FIG. 3 shows a modified mounting of the suction head 3. Rather than securing the suction head 3 to the ceiling of the weaving hall, it may also be secured to the loom itself. A support such as a rail 28 is mounted to the right and left loom frame sections 15. Two mounting studs 29 at each end or side of the loom carry the rail 28 above the weaving plane 2. The rail 28 extends across the weaving width of the loom 1. The blower head 3 is mounted on the rail 28 for back and forth movement as indicated by the arrow 28A. The supply of blowing air takes place through a supply conduit 3B including an electrically controllable valve 3C in the flexible hose 3B leading to the blower head 3 from the blower shown in FIG. 1.

Although the invention has been described with reference to specific example embodiments, it will be appreciated that it is intended to cover all modifications and equivalents within the scope of the appended claims.

What is claimed is:

1. A weaving loom, comprising a loom backrest and a beat-up line defining a weaving plane passing approximately tangentially to said loom backrest and said beat-up line, said weaving loom further comprising a blower head mounted above said weaving plane for blowing an airstream into said loom, and a suction device in said loom mounted below said weaving plane, said suction device comprising a plurality of suction boxes (18) each having a plurality of suction slots therein for collecting fly lint and dust in said suction boxes, and articulating connector elements (21) pivotally linking said suction boxes to one another to form a suction channel chain (17) positioned in said loom below said weaving plane for reducing deposition of fly lint and dust.

2. The weaving loom of claim 1, wherein said articulating connector elements comprise a plurality of links (20, 20A) and pivots interconnecting neighboring suction boxes, said suction device further comprising flexible suction hose sections and control valves for connecting said suction boxes through said hose sections to a suction source so that suction in said suction boxes is controllable through said control valves to form groups of suction boxes which are controllable independently of each other in their suction effect.

3. The weaving loom of claim 2, wherein said blower head is sized and positioned in said loom for cooperation with each of said groups of suction boxes or with any one of said suction boxes.

4. The weaving loom of claim 1, wherein said suction slots are positioned in a suction box wall facing approximately toward weft threads and toward heald frames in said loom.

5. The weaving loom of claim 4, wherein said suction slots comprise flow control members for varying a cross-sectional flow area of said suction slots.

6. The weaving loom of claim 1, wherein each of said suction boxes (18) comprises a connector (19) at each end, said apparatus further comprising links (20, 20A) connecting said articulating connector elements (21) with said connectors (19) for forming a link chain in which said suction boxes are flexibly held.

7. The weaving loom of claim 6, further comprising a suction duct, at least one connector (19) of each suction box (18) comprising a suction nipple (24), and flexible hose sections connected at one end to said suction nipple and at the other end to said suction duct.

8. The weaving loom claim 6, wherein said articulating connector elements (21) are positioned outside said suction boxes between two neighboring suction boxes.

9. The weaving loom of claim 1, further comprising at least one support rail (16) having a configuration adapted to space available in said loom, said support rail being mounted in said loom, said suction channel chain (17) being supported on said support rail.

10. The weaving loom of claim 1, further comprising flow control valves for said blower head and for said suction device for controlling air flow through said loom.

* * * * *